US005500974A

United States Patent [19]

Wu

[11] Patent Number: 5,500,974

[45] Date of Patent: Mar. 26, 1996

[54] DEVICE FOR DREDGING WASTE CLOGGED IN A TOILET, DRAINPIPE, AND THE LIKE

[76] Inventor: Chung K. Wu, No. 248, Sec. 1, Nan Kuo Rd., Chang Hua City, Chang Hua Hsien, Taiwan

[21] Appl. No.: 512,774

[22] Filed: Aug. 9, 1995

Related U.S. Application Data

[63] Continuation-in-part of Ser. No. 316,912, Oct. 3, 1994, abandoned.

[51] Int. Cl.[6] ..... B08B 9/02

[52] U.S. Cl. ..... 15/104.33

[58] Field of Search ..... 15/104.33

[56] References Cited

U.S. PATENT DOCUMENTS

| | | | |
|---|---|---|---|
| 1,912,525 | 6/1933 | Hotchkiss | 15/104.33 |
| 1,936,119 | 11/1933 | Sachs | 15/104.33 |
| 2,033,670 | 3/1936 | Auer | 15/104.33 |
| 2,803,843 | 8/1957 | Levine | 15/104.33 |
| 3,145,972 | 8/1964 | Sweeney | 15/104.33 |
| 3,473,182 | 10/1969 | Caperton | 15/104.33 |

*Primary Examiner*—Edward L. Roberts, Jr.

*Attorney, Agent, or Firm*—Kolisch, Hartwell, Dickinson, McCormack & Heuser

[57] ABSTRACT

A dredging device includes a casing in which a substantially U-shaped frame is pivotally mounted. A stem portion is rotatably mounted on an upper wall of the casing. A first axle has an upper end securely attached to the stem portion. A drive gear is fixedly mounted around a lower end of the first axle. A second axle is rotatably mounted through a lower section of the frame. A driven gear is fixedly mounted around an upper end of the second axle. A threaded groove is defined in an inner wall of the second axle. A third axle has a first end rotatably mounted through a mediate portion of a side section of the frame. A transmission gear is fixedly mounted around the third axle and meshes between the drive gear and the driven gear. A reel is securely mounted on a second end of the third axle. A length of stranded rope is wound around the reel and has a free end extending through the threaded groove in the second axle to outside of the lower wall of the casing. An outer threaded portion is formed on the length of stranded rope. A spiral portion is formed on the free end of the wire.

2 Claims, 5 Drawing Sheets

DEVICE FOR DREDGING WASTE CLOGGED IN A TOILET, DRAINPIPE, AND THE LIKE

The present invention refers to a Continuation-In-Part Application of the Applicant's U.S. Pat. No. 08/316,912, filed on Oct. 3, 1994 and now abandoned.

BACKGROUND OF THE INVENTION

1. Field of Invention

The present invention relates to a dredging device, and more particularly to a device for dredging wastes clogged in a toilet, drainpipe and the like.

2. Related Prior Art

A conventional device for dredging solid matter clogged in a toilet or waste clogged in a drainpipe is shown in FIG. 5. However, by such an arrangement, the user has to repeat a cumbersome and tedious operational process, so incurring inconvenience and complexity during the process of the operation. In addition, a user has to directly touch a dredging wire which is adhered with matter or waste, so easily touching the matter or waste thereon, thereby having a tendency to cause an uncomfortable sense of touch to the user.

There will be a thorough illustration in the detailed description of the preferred embodiments, concerning the conventional dredging device.

The present invention has arisen to mitigate and/or obviate disadvantages of the conventional dredging device.

SUMMARY OF THE INVENTION

The primary objective of the present invention is to provide a dredging device comprising a rigid spiral portion which is able to displace straight downwardly when there are not any obstacles existing during the travel process thereof and is able to rotate when encountering resistance in order to penetrate and dredge solid matter clogged in the toilet and waste clogged in the drainpipe.

In accordance with one aspect of the present invention, there is provided a dredging device comprising a casing having an upper wall, a lower wall and two opposite vertical side walls. A stem portion is rotatably mounted on the upper wall of the casing. A substantially U-shaped frame is pivotally mounted in the casing and has an upper section pivotally engaged with the upper wall of the casing, a lower section pivotally engaged with the lower wall of the casing, and a side section.

A first axle has an upper end which extends through the upper section of the frame and the upper wall of the casing and is securely attached to the stem portion to rotate therewith, and has a lower end. A drive gear is fixedly mounted around the lower end of the first axle to rotate therewith.

A second axle having a center line aligning with that of the first axle includes an upper end and a lower end which is rotatably mounted through the lower section of the frame and the lower wall of the casing. A driven gear is fixedly mounted around the upper end of the second axle to rotate therewith. A longitudinal passage is vertically defined through an inner wall of the second axle and communicates with outside of the lower wall of the casing. A threaded groove is defined in an upper portion of the inner wall of the second axle and communicates with the longitudinal passage.

A third axle has a first end rotatably mounted through a mediate portion of the side section of the frame and a second end. A transmission gear is fixedly mounted around the third axle to rotate therewith and meshes between the drive gear and the driven gear.

A reel is securely mounted on the second end of the third axle to rotate therewith. A length of flexible stranded rope is wound around the reel and has a free end extending through the passage and the threaded groove in the second axle to outside of the lower wall of the casing. An outer threaded portion is formed on the length of stranded rope for threaded engagement with the threaded groove of the second axle. A spiral portion is formed on the free end of the stranded rope.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 5:
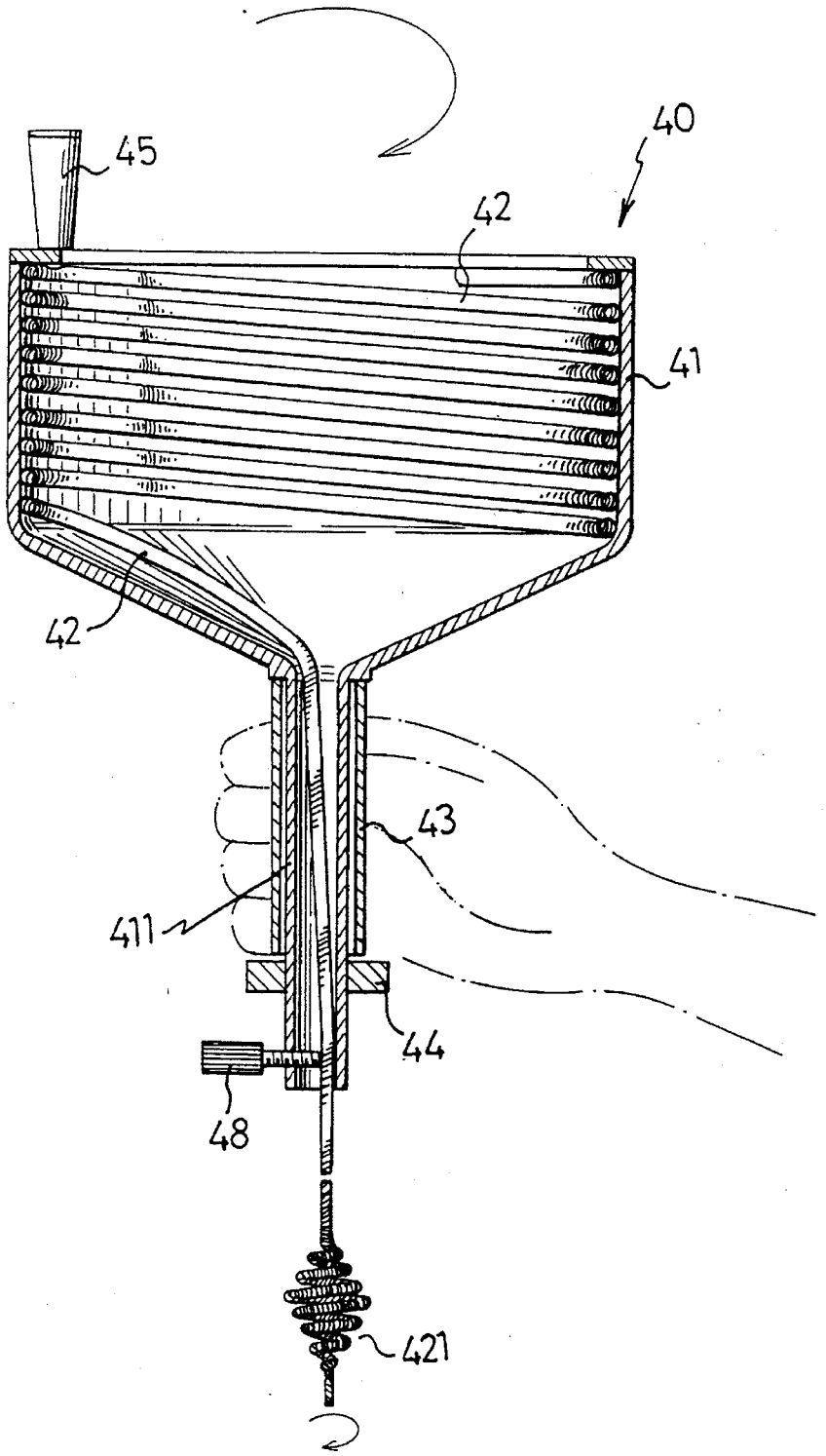
FIG. 5 PRIOR ART
FIG. 5 is front plan cross-sectional view of a conventional dredging device in accordance with the prior art.

For a better understanding of features and benefits of the present invention, reference is made to FIG. 5, illustrating a conventional device in accordance with the prior art for dredging solid matter clogged in a toilet or waste clogged in a drainpipe.

The conventional dredging device 40 comprises a funnel-shaped container 41. A handle portion 45 is rotatably mounted on an upperside of the container 41. A length of wire 42 is helically wound in an upper section of the container 41 and has a free end extending through a neck portion 411 of the container 41 to outside thereof. A rigid spiral portion 421 is integrally formed on the free end of the wire 42. A holder 43 is rotatably mounted around the neck portion 411 of the container 41. A stop 44 is fixedly mounted around the neck portion 411 for retaining the holder 43. An adjusting bolt 48 threadedly extends through a lower end of the neck portion 411 for retaining the free end of the wire 42.

In operation, a user can manipulate the dredging device 40 with one of his/her hands holding the holder 43 and the other hand holding the handle portion 45 to rotate the container 41 relative to the holder 43, thereby rotating the rigid spiral portion 421 via the wire 42 to penetrate waste or solid matter so as to dredge the toilet or the drainpipe (not shown).

The adjusting bolt 48 is then screwed backwardly, thereby releasing the free end to extract and lengthen the wire 42 to an extent by means of one hand of the user so as to move the rigid spiral portion 421 straight downwardly in the toilet (or the drainpipe) until reaching further solid matter (or waste). The adjusting bolt 48 is again screwed inwards of the neck portion 411 to retain the free end of the wire 42 in position. The user can again rotate the container 41 relative to the holder 43 in order to rotate the rigid spiral portion 421 to penetrate and dredge the further solid matter or wastes.

The above-mentioned process is executed again and again until the solid matter or waste is completely dredged and cleared. By such an arrangement, the user must repeat a cumbersome and tedious operational process, that is, unscrewing the adjusting bolt 48 thereby extracting the wire 42, then screwing the adjusting bolt 48 tightly thereby positioning the wire 42, then rotating the container 41 relative to the holder 43 to rotate the rigid spiral portion 421, so incurring inconvenience and complexity of the operation.

In addition, the user has to directly touch the free end of the wire 42, so having a tendency to touch the solid matter or waste, thereby easily causing an uncomfortable sense of touch to the user.

Figure 1:
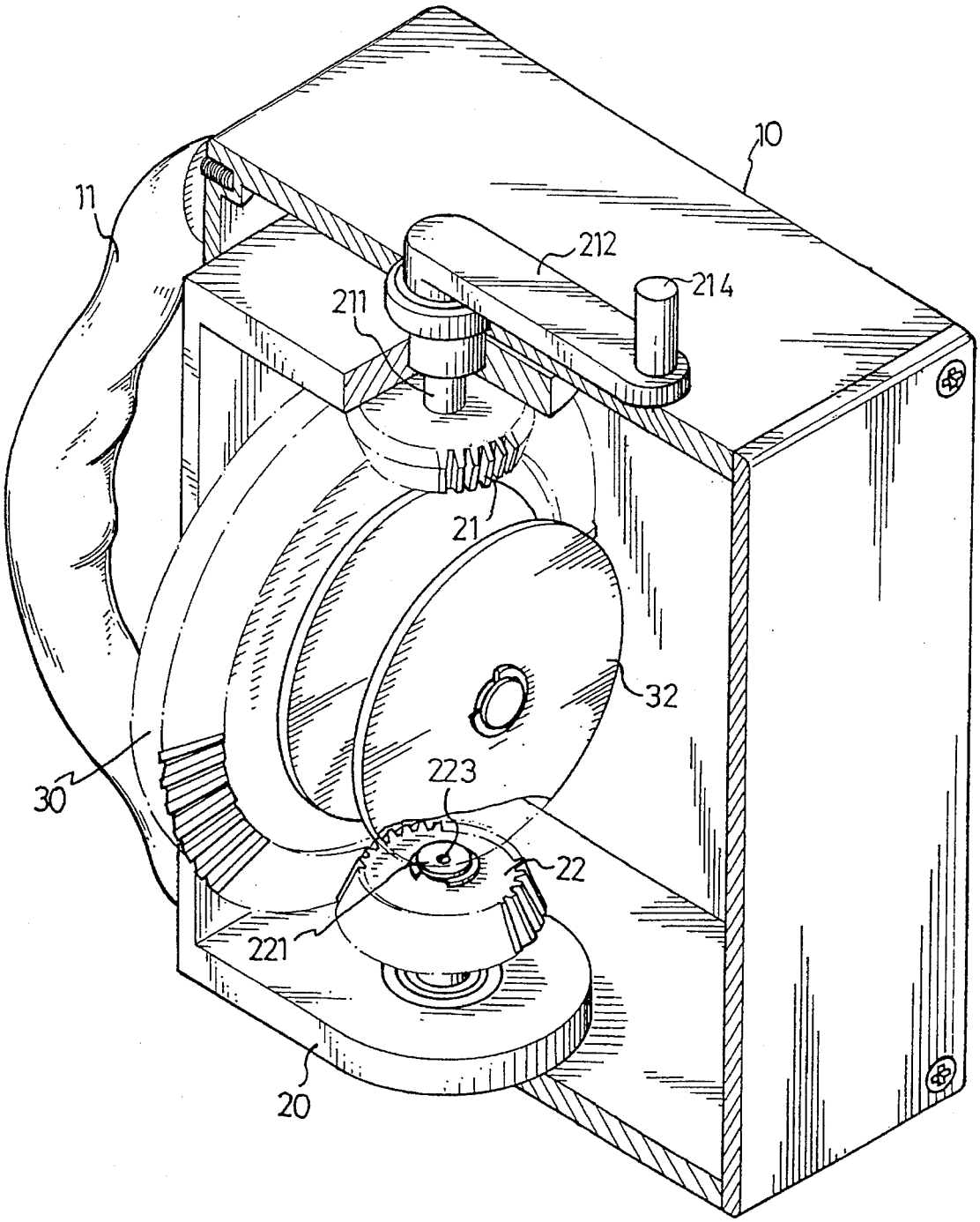
FIG. 1 is a perspective view in partial section showing a dredging device in accordance with the present invention.
Figure 2:
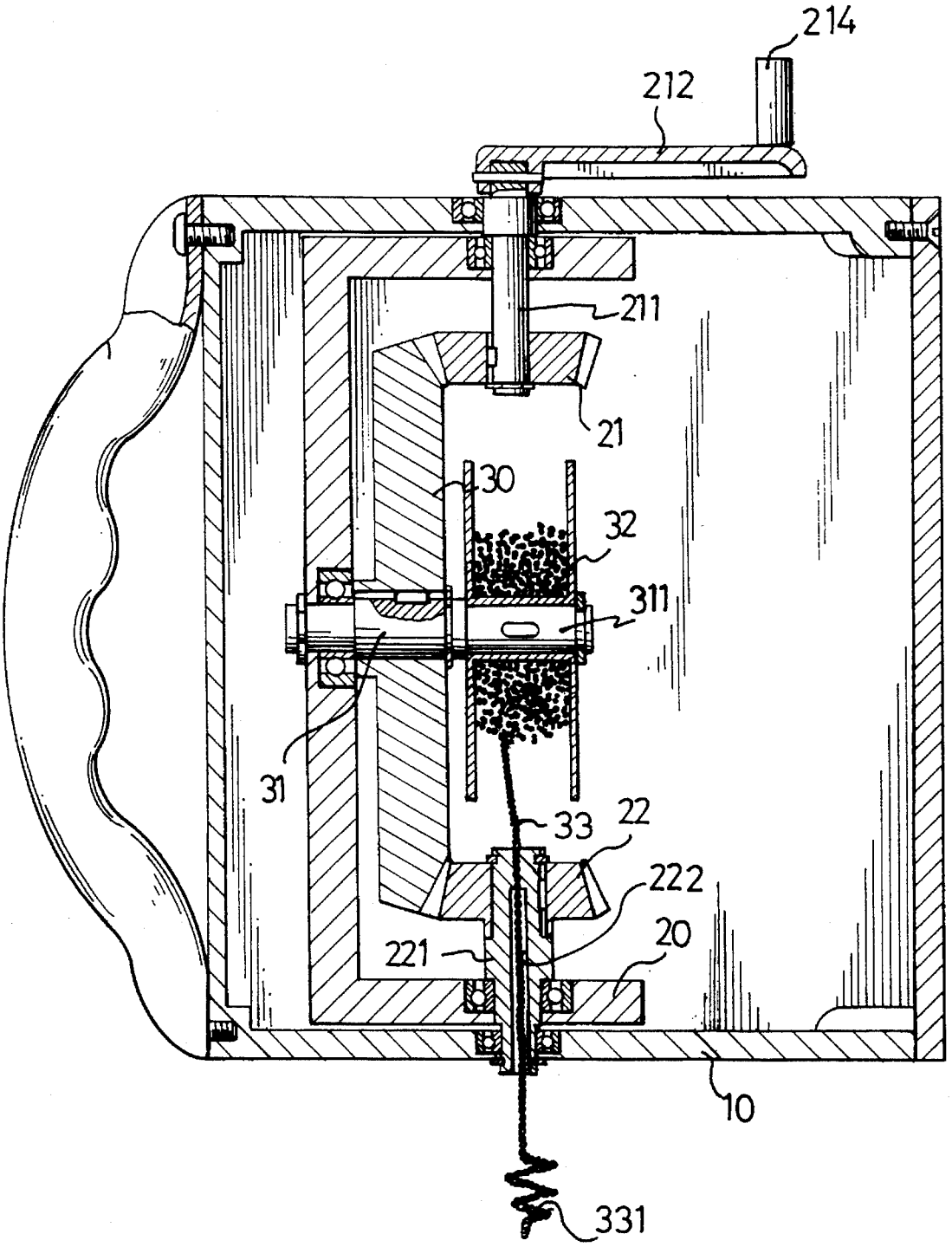
FIG. 2 is a front cross-sectional view of the dredging device as shown in FIG. 1.
Figure 3:
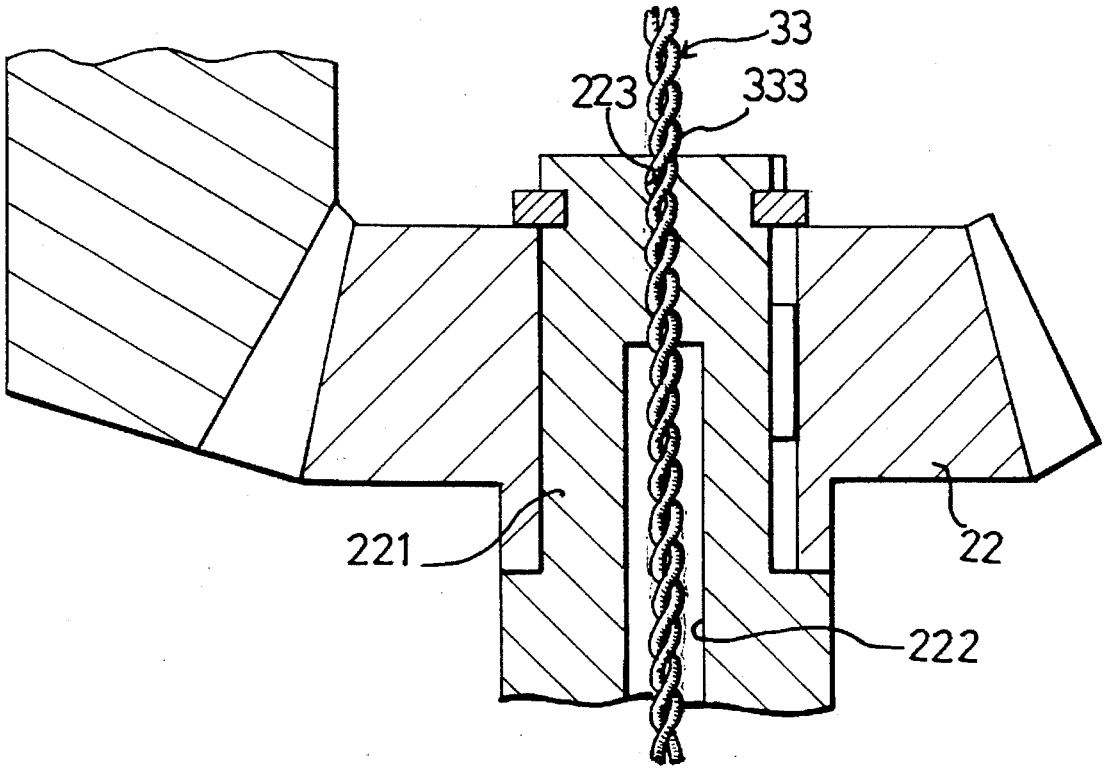
FIG. 3 is a partially enlarged cross-sectional view of FIG. 2.

Referring to FIGS. 1–4, and initially to FIGS. 1–3, a device in accordance with the present invention is provided for dredging dirt or excreta clogged in a toilet or waste clogged in a drainpipe. The dredging device comprises a casing 10 having an upper wall, a lower wall and two opposite vertical side walls. A stem portion 212 has a first end rotatably mounted on the upper wall of the casing 10 and a second end around which a rotary member 214 is pivotally mounted. An arcuate handle portion 11 is attached on one of the vertical side walls of the casing 10.

A substantially U-shaped frame 20 is pivotally mounted in the casing 10 and having an upper section pivotally engaged with the upper wall of the casing 10, a lower section pivotally engaged with the lower wall of the casing 10, and a side section.

A first axle 211 has an upper end extending through the upper section of the frame 20 and the upper wall of the casing 10 and is securely attached to the first end of the stem portion 212 to rotate therewith. A drive beveled gear 21 is fixedly mounted around a lower end of the first axle 211 to rotate therewith.

A second axle 221 has an upper end and a lower end which is rotatably mounted through the lower section of the frame 20 and the lower wall of the casing 10. A driven beveled gear 22 is fixedly mounted around the upper end of the second axle 221 to rotate therewith. A longitudinal passage 222 is vertically defined in an inner wall of the second axle 221 and communicates with outside of the lower wall of the casing 10. A threaded groove 223 is defined in an upper portion of the inner wall of the second axle 221 and communicates with the longitudinal passage 222. Preferably, the second axle 221 has a center line aligning with that of the first axle 211.

A third axle 31 has a first end rotatably mounted through a mediate portion of the side section of the frame 20. A transmission gear 30 is fixedly mounted around the third axle 31 to rotate therewith and meshes between the drive beveled gear 21 and the driven beveled gear 22. A reel 32 is securely mounted around a second end 311 of the third axle 31 to rotate therewith.

A length of flexible stranded rope 33 is wound around the reel 32 and has a free end extending through the passage 222 and the threaded groove 223 in the second axle 221 to outside of the lower wall of the casing 10. An outer threaded portion 333 (see FIG. 3) is formed on the length of stranded rope 33 for threaded engagement with the threaded groove 223 of the second axle 221. A rigid spiral portion 331 is integrally formed on the free end of the wire 33.

In operation, referring to FIGS. 2 and 3, a user can operate the dredging device with one of his/her hands holding the handle portion 11 and the other hand holding the rotary member 214 to rotate the stem portion 212 about the first end thereof in a clockwise manner, thereby rotating the drive beveled gear 21 via the first axle 211 to subsequently actuate the transmission gear 30 to rotate therewith so as to rotate the second axle 221 via the driven beveled gear 22, thereby moving the length of stranded rope 33 downwardly by means of threaded engagement between the threaded groove 223 of the second axle 221 and the outer threaded portion 333 of the stranded rope 33 such that the free end of the wire 32 is able to move downwardly through the threaded groove 223 and the passage 222 of the second axle 221, thereby forcing the rigid spiral portion 331 to move straight downwardly into the toilet or drainpipe (not shown).

When the rigid spiral portion 331 comes into contact with solid matter clogged in the toilet or waste clogged in the drainpipe; a further downward movement of the stranded rope 33 is stopped by the solid matter, thereby stopping rotation of the second axle 221 which in turn stops rotation of the drive beveled gear 22, the transmission gear 30 and the driven beveled gear 21.

Figure 4:
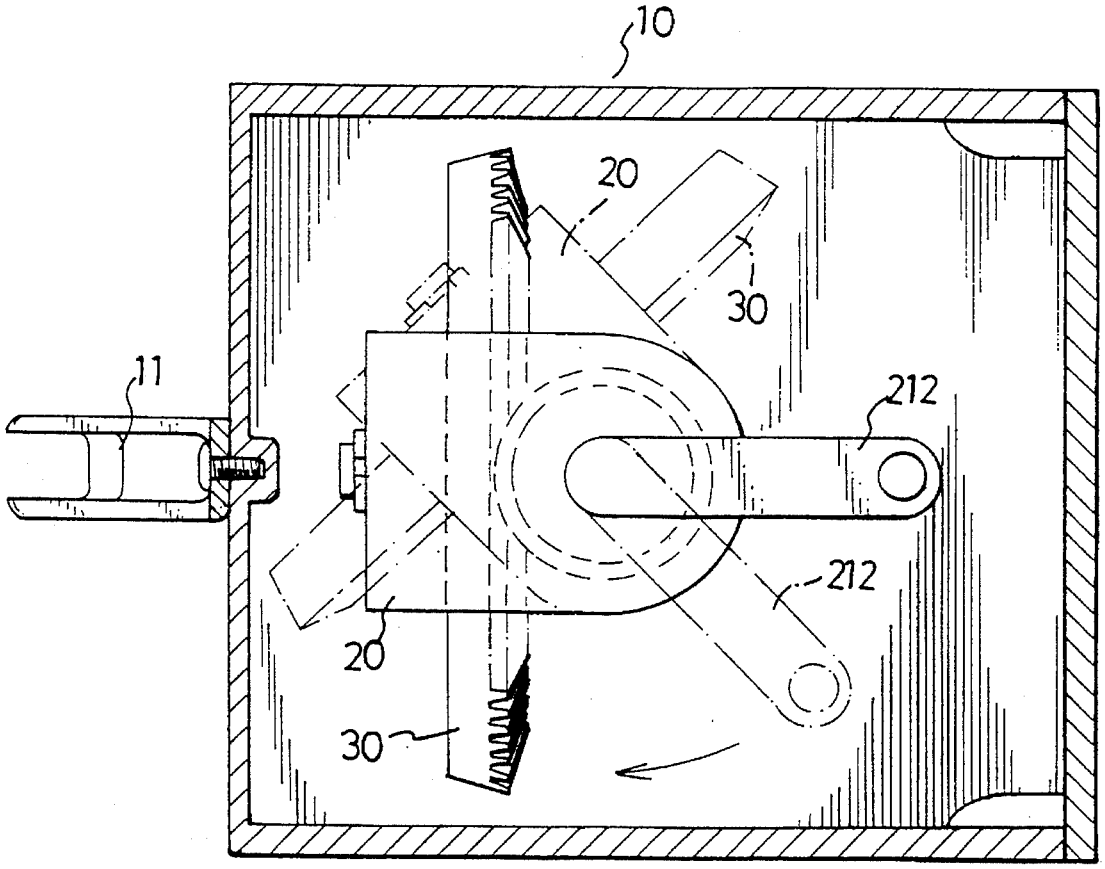
FIG. 4 is a top plan partially cross-sectional view showing an operation of the dredging device.

Referring to FIG. 4, when the user further exerts a force to turn the stem portion 212 clockwise so as to drive the first axle 211 to rotate the drive beveled gear 21, because the rotation of the drive beveled gear 21 is stopped by the transmission gear 30, therefore, the rotational force exerting on the drive beveled gear 21 is transferred to force the transmission gear 30 together with the reel 32 to pivot about the first and second axles 211 and 221, thereby driving the frame 20 to pivot about the first and second axles 211 and 221 via the third axle 31 as best shown in phantom lines.

The rigid spiral portion 331 is then rotated by means of rotation of the stranded rope 33 turned by the reel 32 so as to penetrate through the solid matter clogged in the toilet or waste clogged in the drainpipe. When solid matter and waste have already been penetrated and dredged by the rigid spiral portion 331 which is able to continue to travel downwardly, the pivotal movement of the transmission gear 30 together with the frame 20 will cease and the transmission gear 30 is thus able to be rotated again by the drive beveled gear 21, thereby rotating the second axle 221 via the driven beveled gear 22 again to move the stranded rope 33 downwardly by threaded engagement between the threaded groove 223 of the second axle 221 and the outer threaded portion 333 of the stranded rope 33 to continuously move the rigid spiral portion 331 downwardly whose downward movement will be stopped when reaching a position where further solid matter or waste exist.

The dredging operation is thus repeated continuously. By such an arrangement, the rigid spiral portion 331 is able to displace straight downwardly when there is not any obstacle existing during the travel course thereof and is able to rotate when encountering resistance in order to penetrate and dredge solid matter clogged in the toilet and waste clogged in the drainpipe.

It should be clear to those skilled in the art that further embodiments of the present invention may be made without departing from the teachings of the present invention.

What is claimed is:

1. A device for dredging wastes comprising:

a casing (10) having an upper wall, a lower wall and two opposite vertical side walls, a stem portion (212) rotatably mounted on the upper wall of said casing (10);

a substantially U-shaped frame (20) mounted in said casing (10) and having an upper section pivotally engaged with the upper wall of said casing (10), a lower section pivotally engaged with the lower section of said casing (10), and a side section;

a first axle (211) having an upper end which extends through the upper section of said frame (20) and the upper wall of said casing (10) and securely attached to said stem portion (212) to rotate therewith, and having a lower end, a drive gear (21) fixedly mounted around the lower end of said first axle to rotate therewith;

a second-axle (221) having a center line aligning with that of said first axle (211) and having an upper end and a lower end which is rotatably mounted through the lower section of said frame (20) and the lower wall of said casing (10), a driven gear (22) fixedly mounted around the upper end of said second axle (221) to rotate therewith, a longitudinal passage (222) vertically defined in an inner wall of said second axle (221) and communicating with outside of the lower wall of said casing (10), a threaded groove (223) defined in an upper portion of the inner wall of said second axle (221) and communicating with said longitudinal passage (222); and a third axle (31) having a first end rotatably mounted through a mediate portion of the side section of said frame (20) and a second end (311), a transmission gear (30) fixedly mounted around said third axle (31) to rotate therewith and meshing between said drive gear (21) and said driven gear (22), a reel (32) securely mounted on the second end (311) of said third axle (31) to rotate therewith, a length of stranded rope (33) wound around said reel (32) and having a free end extending through said threaded groove (223) and said longitudinal passage (222) in said second axle (221) to outside of the lower wall of said casing (10), an outer threaded portion (333) formed on said length of stranded rope (33) for threaded engagement in said threaded groove (223), a spiral portion (331) formed on the free end of said stranded rope (33).

2. The dredging device in accordance with claim 1, further comprising an arcuate handle portion (11) attached on one of the vertical side walls of said casing (10).

* * * * *